US010264627B2

(12) United States Patent
Hartzler et al.

(10) Patent No.: US 10,264,627 B2
(45) Date of Patent: Apr. 16, 2019

(54) ADJUSTING CNT RESISTANCE USING PERFORATED CNT SHEETS

(71) Applicant: Goodrich Corporation, Charlotte, NC (US)

(72) Inventors: Brad Hartzler, Doylestown, OH (US); Tommy M. Wilson, Jr., Cuyahoga Falls, OH (US); Galdemir Cezar Botura, Akron, OH (US); Wenping Zhao, Glastonbury, CT (US); Zaffir A. Chaudhry, S. Glastonbury, CT (US); James A. Mullen, Wadsworth, OH (US)

(73) Assignee: Goodrich Corporation, Charlotte, NC (US)

( * ) Notice: Subject to any disclaimer, the term of this patent is extended or adjusted under 35 U.S.C. 154(b) by 26 days.

(21) Appl. No.: 15/373,363

(22) Filed: Dec. 8, 2016

(65) Prior Publication Data

US 2018/0168001 A1 Jun. 14, 2018

(51) Int. Cl.
*H05B 3/20* (2006.01)
*H05B 3/10* (2006.01)
(Continued)

(52) U.S. Cl.
CPC ..... *H05B 3/145* (2013.01); *H05B 3/0014* (2013.01); *H05B 3/34* (2013.01); *H05B 2203/01* (2013.01);
(Continued)

(58) Field of Classification Search
CPC ... H05B 3/10; H05B 3/12; H05B 3/14; H05B 3/145; H05B 3/146; H05B 3/20; H05B 3/28; H05B 3/40–3/58
(Continued)

(56) References Cited

U.S. PATENT DOCUMENTS 7,288,490 B1 * 10/2007 Delzeit ..... B82Y 30/00 257/E21.128
7,947,145 B2 * 5/2011 Wang ..... B32B 27/08 156/281
(Continued)

FOREIGN PATENT DOCUMENTS

EP 1826119 A2 8/2007
EP 3013119 A1 4/2016
(Continued)

OTHER PUBLICATIONS

Extended European Search Report for EP Serial No. 17205719.2, dated May 3, 2018, 7 Pages.

*Primary Examiner* — Michael A Laflame, Jr.
(74) *Attorney, Agent, or Firm* — Kinney & Lange, P.A.

(57) ABSTRACT

One example of a heating element includes a first carbon nanotube (CNT) layer and a second CNT layer. At least a portion of the first CNT layer overlaps at least a portion of the second CNT layer, and the first CNT layer includes a first perforated region having a plurality of perforations. Another heating element includes a CNT sheet with a first perforated region having a plurality of perforations and a first perforation density and a second perforated region having a plurality of perforations and a second perforation density different from the first perforation density. A method of forming a heating element includes perforating a first CNT layer so that it includes a perforated region and stacking the first CNT layer with a second CNT layer such that at least a portion of the first CNT layer overlaps at least a portion of the second CNT layer.

18 Claims, 2 Drawing Sheets

(51) Int. Cl.

| | |
|---|---|
| ***H05B 3/12*** | (2006.01) |
| ***H05B 3/14*** | (2006.01) |
| ***H05B 3/40*** | (2006.01) |
| ***H05B 3/00*** | (2006.01) |
| ***H05B 3/34*** | (2006.01) |

(52) U.S. Cl.
CPC .. *H05B 2203/013* (2013.01); *H05B 2203/037* (2013.01); *H05B 2214/04* (2013.01)

(58) Field of Classification Search
USPC ..... 219/538–553
See application file for complete search history.

(56) References Cited

U.S. PATENT DOCUMENTS 8,450,930 B2 * 5/2013 Liu ..... H01J 29/20 313/315
8,664,573 B2 3/2014 Shah et al.
2005/0266766 A1 * 12/2005 Wei ..... B82Y 10/00 445/50
2006/0172179 A1 * 8/2006 Gu ..... B82Y 30/00 429/482
2010/0147829 A1 * 6/2010 Liu ..... H05B 3/145 219/546
2010/0176118 A1 7/2010 Lee et al.
2011/0240111 A1 * 10/2011 Yamazaki ..... B82Y 20/00 136/256
2012/0171411 A1 * 7/2012 Lashmore ..... B32B 5/022 428/114
2014/0070054 A1 3/2014 Burton et al.
2014/0072778 A1 * 3/2014 Feng ..... H01B 1/24 428/195.1
2014/0209375 A1 7/2014 Linow et al.
2015/0189699 A1 * 7/2015 Ploshikhin ..... H05B 3/34 219/541
2015/0321147 A1 * 11/2015 Fleming ..... B01D 65/003 210/489
2016/0145784 A1 * 5/2016 Schauer ..... D04H 1/559 442/327

FOREIGN PATENT DOCUMENTS

WO WO2016081690 A1 5/2016
WO WO2016126827 A1 8/2016
WO WO2016144683 A1 9/2016

* cited by examiner

ADJUSTING CNT RESISTANCE USING PERFORATED CNT SHEETS

BACKGROUND

Carbon nanotubes (CNTs) are carbon allotropes having a generally cylindrical nanostructure. They have unusual properties that make them valuable for many different technologies. For instance, some CNTs can have high thermal and electrical conductivity, making them suitable for replacing metal heating elements. Due to their much lighter mass, substituting CNTs for metal heating components can reduce the overall weight of a heating component significantly. This makes the use of CNTs of particular interest for applications where weight is critical, such as in aerospace and aviation technologies.

Carbon nanotubes are commercially available in several different forms. Forms include pure carbon nanotube nonwoven sheet material (CNT-NSM) and CNT-filled thermoplastic films. In a CNT-NSM, carbon nanotubes are arranged together to form a sheet. No adhesives or polymers are typically used to attach CNTs to one another in a CNT-NSM. Instead, CNT particles are attached to one another via Van der Waals forces. In a CNT-filled thermoplastic film, individual CNT particles are distributed throughout the film. Unfortunately, these commercially available CNT materials do not offer off-the-shelf electrical resistivities that allow for their use in different ice protection applications.

SUMMARY

A heating element includes a first carbon nanotube (CNT) layer and a second CNT layer. At least a portion of the first CNT layer overlaps at least a portion of the second CNT layer, and the first CNT layer includes a first perforated region having a plurality of perforations.

A heating element includes a perforated CNT sheet.

A method of forming a heating element containing carbon nanotubes includes perforating a first CNT layer so that it includes a perforated region having a plurality of perforations and stacking the first CNT layer with a second CNT layer such that at least a portion of the first CNT layer overlaps at least a portion of the second CNT layer.

DETAILED DESCRIPTION

This disclosure provides the ability to tailor the resistivity of carbon nanotubes (CNT) to application-specific heating or ice protection needs by utilizing perforated CNT sheets or stacked CNT sheets or layers where at least one of the CNT layers is perforated. Using perforated CNT sheets or combining perforated and non-perforated CNT sheet layers in one heating element will allow the resistivity of the heating element to be varied to suit individual application heating, anti-icing and/or de-icing needs.

Figure 1:
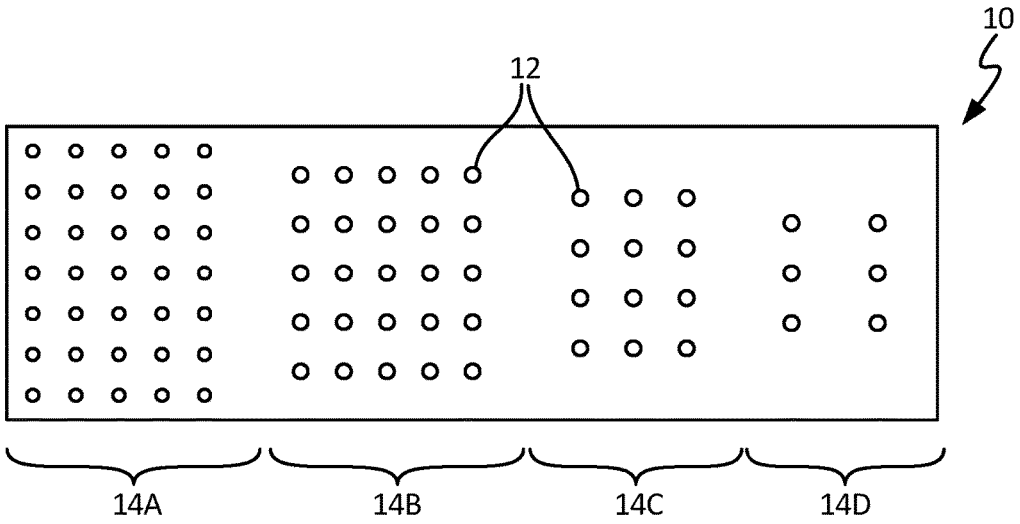
FIG. 1 is a schematic view of a perforated CNT sheet.

FIG. 1 schematically illustrates one example of a perforated CNT material layer suitable for use as a heating element. One or more CNT layers can be connected to an electric power source. When current is passed through the CNT layer(s), the CNTs within the layer(s) emit heat energy (i.e. Joule heating).

As shown in FIG. 1, CNT layer 10 can be a CNT sheet, such as a carbon nanotube nonwoven sheet material (CNT-NSM). Carbon nanotube sheets are generally manufactured as a flat sheet or tape that is very thin, as thin or thinner than the thickness of an ordinary sheet of paper (about 0.07 to 0.18 millimeters). Some CNT sheets have a thickness as small as about 127 μm (0.5 mils). As described above, CNT-NSMs do not typically include adhesives, resins or polymers and CNTs present in the sheet are held together by Van der Waals forces. Van der Waals forces are non-covalent and non-ionic attractive forces between CNTs caused by fluctuating polarizations of the CNTs. Individual carbon nanotubes 12 can align themselves by pi-stacking, one type of Van der Waal interaction. Pi-stacking refers to attractive, non-covalent interactions between aromatic rings that occur due to the presence of pi bonds. As each carbon ring within a CNT possesses pi bonds, pi-stacking occurs between nearby CNTs. "Dry" CNT sheets (those having no adhesives, resins or polymers) generally have a uniform electrical resistance.

In other embodiments, CNT layer 10 can be a CNT-filled thermoplastic film. Carbon nanotube-filled thermoplastic films include a thermoplastic matrix through which CNT particles are dispersed. The thermoplastic matrix is typically a solid at room temperature (~25° C.). Examples of suitable materials for the thermoplastic matrix include epoxies, phenolic resins, bismaleimides, polyimides, polyesters, polyurethanes and polyether ether ketones. The electrical resistivity of CNT-filled thermoplastic films can vary depending on the uniformity of the distribution of CNT particles within the film. Where CNTs are generally uniformly distributed throughout the film, the electrical resistance is generally uniform throughout the film.

Carbon nanotube layer 10 can be attached or, in the case of composite components, embedded underneath an outer skin of a component (not shown) requiring ice protection (e.g., anti-icing and/or de-icing). An electric power source is connected to CNT layer 10. When electric current passes through CNT layer 10, heat is given off by the CNTs present within layer 10 by Joule heating. This heat provides ice protection to the component in which CNT layer 10 is attached, embedded or installed. In other embodiments, CNT layer 10 can be used in other heating applications, such as wind turbines, heated floor panels, local comfort heating applications, area heating, water tank heating blankets and other aerospace heating applications.

As described herein, whether a CNT sheet or a CNT-filled thermoplastic film, creating perforations within CNT layer 10 allows the electrical resistivity of CNT layer 10 to be modified to suit particular ice protection applications.

As shown in FIG. 1, carbon nanotube layer 10 includes a plurality of perforations 12. The presence of perforations 12 in CNT layer 10 affects the electrical resistivity of CNT layer 10. It is expected that perforating a CNT layer will generally increase its resistivity in the region of the perforations. Additionally, in some embodiments, the voids created by perforations 12 do not contain conductive material. Once CNT layer 10 is attached, embedded or installed on a component, the void space created by perforations 12 is filled with an adhesive, resin or polymer. When the perforation void space contains nonconductive material, it creates a localized area near perforation 12 where no heat is emitted from CNT layer 10. In some cases, a conducting adhesive or polymer is present in the voids created by perforations 12. In these instances, the conducting adhesive or polymer can have an electrical resistivity different from CNT layer 10, allowing tuning of the heat emitted by CNT layer 10.

FIG. 1 illustrates CNT layer 10 having four different perforated regions 14A-D. Each region 14 has a different perforation density. For the purposes of this disclosure, perforation density refers to the number of perforations in a given area and the general size of the perforations. Perforation density can change by increasing or decreasing the number of perforations in a region or increasing or decreasing the average diameter of the perforations in a region. At the same time, a region with a large number of small holes can have the same perforation density as a region with a small number of large holes. Perforation density of CNT layer 10 can vary depending on the desired electrical resistivity of CNT layer 10 and the heating element to which it belongs. In some embodiments, about 10% to about 50% of the surface area of a perforated region of CNT layer 10 is "open" (i.e. void space created by perforations 12 where no CNTs are present). In other embodiments, about 20% to about 40% of the surface area of a perforated region of CNT layer 10 is open.

In some embodiments, perforations 12 can have generally the same diameter. In other cases, some perforations 12 can have different diameters than others. Perforations 12 can be circular or perforations 12 can take other geometric shapes. In some embodiments, perforations 12 can be uniformly distributed throughout a region 14 of CNT layer 10. In some cases, CNT layer 10 can include a region with perforations and a region without perforations. The presence or absence of perforations is used to tailor the electrical resistivity of CNT layer 10. Perforating CNT layer 10 allows its use for heating applications in aerospace, marine and wind turbines and other related technologies.

As perforations 12 in CNT layer 10 all have essentially the same diameter, the perforation density increases, by region, from right to left across CNT layer 10 as shown in FIG. 1. Region 14A has the greatest perforation density, while region 14D has the smallest perforation density. Because of the differing perforation densities, each of the different regions 14 of CNT layer 10 has a different electrical resistivity. Region 14A is expected to have the highest electrical resistivity on CNT layer 10 while region 14D is expected to have the lowest. By altering the electrical resistivity of different regions 14 of CNT layer 10, CNT layer 10 can be tuned to provide the desired amount of heating to different regions 14 when an electric current is passed through CNT layer 10. Thus, rather than evenly heating the component to which CNT layer 10 is attached, CNT layer 10 can provide selective heating to the component depending on the perforation density of various regions of CNT layer 10.

Figure 2:
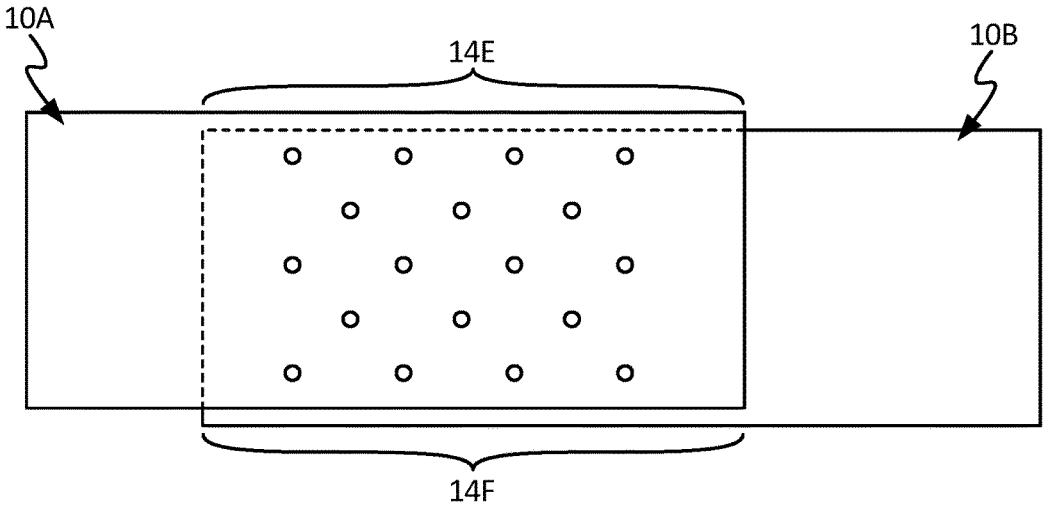
FIG. 2 is a schematic view of one embodiment of a CNT heating element having a perforated CNT layer and a non-perforated CNT layer that overlap.

In other embodiments, multiple CNT layers are used to tune the electrical resistivity of a CNT heating element. FIG. 2 schematically illustrates a perforated CNT layer and a non-perforated CNT layer that overlap. Region 14E of CNT layer 10A and region 14F of CNT layer 10B overlap one another. Region 14E of CNT layer 10A contains perforations 12 while CNT layer 10B does not have perforations and is a solid CNT layer or sheet. Depending on whether CNT layers 10A and 10B are CNT sheets, CNT-filled thermoplastic films or a combination of the two, layers 10A and 10B can merely be placed one on top of the other or connected by a conductive adhesive layer or some other conductor. Carbon nanotube layers 10A and 10B can have the same general electrical resistance in their unperforated state or the CNT layers 10A and 10B can have differing levels of electrical resistance. The presence of perforations 12 changes the electrical resistivity where regions 14E and 14F overlap. Without perforations the overlapping regions could have a low electrical resistance and result in a "cold spot"; the addition of perforations 12 to the overlapping regions can increase the region's electrical resistance and reduce or eliminate such a cold spot.

More than two layers can be stacked together in a similar fashion to form a heating element. For example, the heating element could include one solid layer and two perforated layers, two solid layers and two perforated layers, two solid layers and one perforated layer, three perforated layers, and so on. The use of perforations 12 in one or more of the stacked layers alter the electrical resistance of one or more regions of the stack. In some embodiments, ten to fifteen CNT layers 10 can be stacked together. In this way, the overall electrical resistivity of a heating element made up of CNT layers can be modified based on how the CNT layers are stacked.

Figure 3:
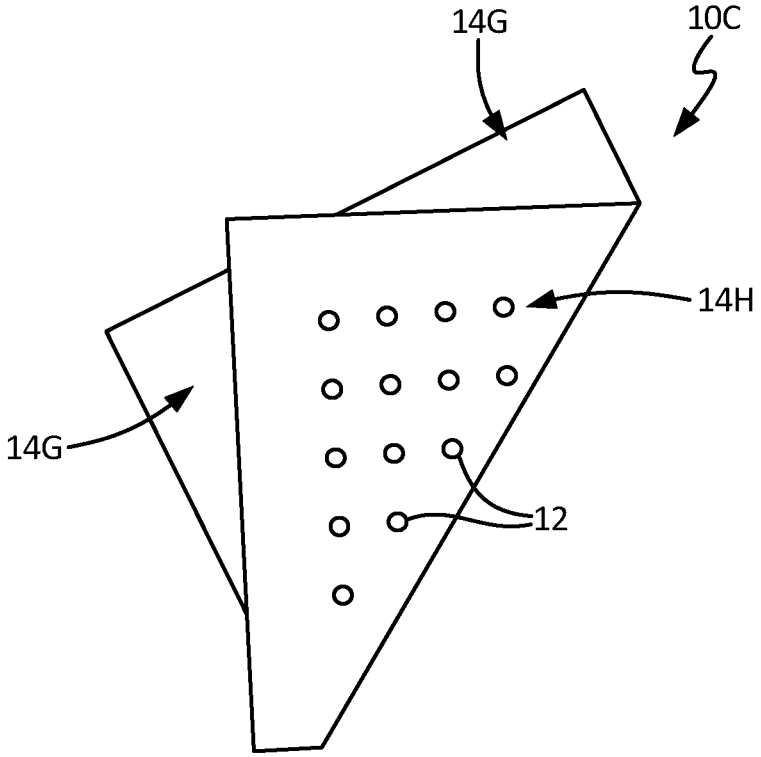
FIG. 3 a schematic view of another embodiment of a CNT heating element having a perforated CNT layer and a non-perforated CNT layer that overlap.

In the embodiment schematically illustrated in FIG. 3, a single CNT sheet (layer 10C) is folded so that it overlaps with itself, forming a heating element that has regions (14G) that are one layer thick and a region (14H) that has multiple layers. In this embodiment, region 14H includes perforations 12 to increase its electrical resistivity. Perforations 12 can be present in one or all of the CNT layers in region 14H. Depending on the number of layers perforations 12 are present in, perforations 12 can be made in CNT sheet 10C before or after folding.

Figure 4:
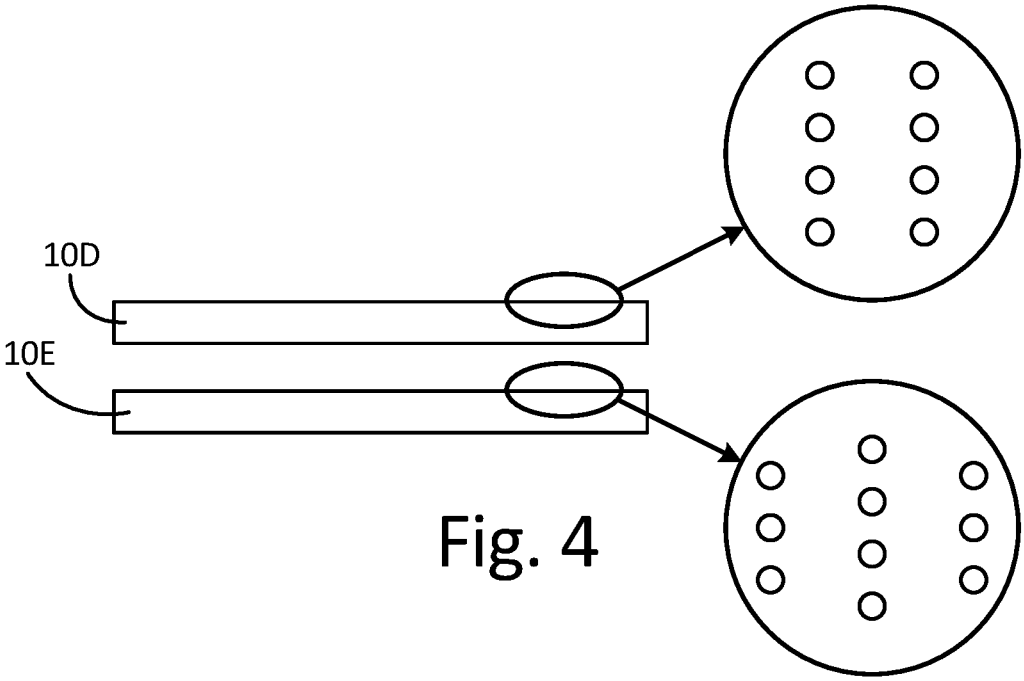
FIG. 4 a schematic view of another embodiment of a CNT heating element having two overlapping perforated CNT layers.

FIG. 4 schematically illustrates an embodiment in which two CNT layers with perforations are stacked. As shown in FIG. 4, CNT layers 10D and 10E each include perforations 12. Carbon nanotube layers 10D and 10E are stacked such that while CNT layers 10D and 10E overlap, perforations 12 in CNT layer 10D do not overlap with perforations 12 in CNT layer 10E. Utilizing a heating element with this configuration of CNT layers 10 provides tuned electrical resistivity while maintaining uniform heating without the use of a solid CNT layer. In other embodiments, perforations 12 in one CNT layer overlap with perforations 12 in another CNT layer. In still other embodiments, perforations 12 in CNT layer 10D can have different diameters than perforations 12 in CNT layer 10E. The number of perforations 12 and/or the perforation density in CNT layers 10D and 10E can also vary.

While the instant disclosure refers particularly to carbon nanotubes, it is theorized that the resistivity of sheets and films containing other electrically conductive carbon allotropes (e.g., graphene nanoribbons) would behave in a similar fashion. Embodiments containing other suitable carbon allotropes are within the scope of the instant disclosure.

The methods disclosed herein provide means for reducing the resistivity of CNT-NSMs and CNT-filled films without increasing their mass or the chemical processes needed to add resistivity-reducing functional groups to the carbon backbone of the CNT materials. The disclosure allows commercially available CNT-NSMs and CNT-filled films to be useful for wind turbine, aerospace and aircraft heating, anti-icing and de-icing applications.

Discussion of Possible Embodiments

The following are non-exclusive descriptions of possible embodiments of the present invention.

A heating element can include a first carbon nanotube (CNT) layer and a second CNT layer where at least a portion of the first CNT layer overlaps at least a portion of the second CNT layer, and where the first CNT layer comprises a first perforated region having a plurality of perforations.

The heating element of the preceding paragraph can optionally include, additionally and/or alternatively, any one or more of the following features, configurations and/or additional components:

The first perforated region of the first CNT layer can overlap with the portion of the second CNT layer.

The second CNT layer can include a second perforated region having a plurality of perforations.

The first perforated region of the first CNT layer can overlap with the second perforated region of the second CNT layer.

The perforations in the first perforated region can be arranged such that they do not overlap perforations in the second perforated region.

At least one of the plurality of perforations in the first perforated region can overlap at least one of the plurality of perforations in the second perforated region.

The first and second CNT layers can be formed from a folded CNT sheet.

The plurality of perforations in the first perforated region can make up about 10% to about 50% of the first perforated region surface area.

The plurality of perforations in the first perforated region can make up about 20% to about 40% of the first perforated region surface area.

The plurality of perforations in the first perforated region can have generally the same diameter.

The plurality of perforations in the first perforated region can be generally uniformly distributed.

A heating element can include a perforated CNT sheet.

The heating element of the preceding paragraph can optionally include, additionally and/or alternatively, any one or more of the following features, configurations and/or additional components:

The CNT sheet can include a first perforated region having a plurality of perforations and a first perforation density and a second perforated region having a plurality of perforations and a second perforation density different from the first perforation density The second perforated region can have a different number of perforations than the first perforated region.

The perforations in the second perforated region can have a different diameter than perforations in the first perforated region.

The plurality of perforations in the first perforated region can make up about 10% to about 50% of the first perforated region surface area, and the plurality of perforations in the second perforated region can make up about 10% to about 50% of the second perforated region surface area.

The plurality of perforations in the first perforated region can make up about 20% to about 40% of the first perforated region surface area, and the plurality of perforations in the second perforated region can make up about 20% to about 40% of the second perforated region surface area.

A method of forming a heating element containing carbon nanotubes can include perforating a first CNT layer so that it has a perforated region having a plurality of perforations and stacking the first CNT layer with a second CNT layer such that at least a portion of the first CNT layer overlaps at least a portion of the second CNT layer.

The method of the preceding paragraph can optionally include, additionally and/or alternatively, any one or more of the following features, configurations and/or additional components:

The first and second CNT layers can be stacked such that the perforated region overlaps with the portion of the second CNT layer.

The method can further include perforating the second CNT layer so that it has a second perforated region having a plurality of perforations.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heating element comprising:

a first carbon nanotube (CNT) layer comprising:

a first perforated region having a plurality of perforations, and a first perforation density, and a first electrical resistivity; and a second perforated region having a plurality of perforations and a second perforation density different from the first perforation density, wherein the second perforated region has a different number of perforations than the first perforated region, and wherein the second perforated region has a second electrical resistivity different than the first electrical resistivity; and a second CNT layer, wherein at least the first perforated region of the first CNT layer overlaps at least a portion of the second CNT layer.

2. The heating element of claim 1, wherein the first perforated region of the first CNT layer overlaps with the portion of the second CNT layer.

3. The heating element of claim 1, wherein the second CNT layer comprises a second perforated region having a plurality of perforations.

4. The heating element of claim 3, wherein the first perforated region of the first CNT layer overlaps with the second perforated region of the second CNT layer.

5. The heating element of claim 4, wherein perforations in the first perforated region do not overlap perforations in the second perforated region.

6. The heating element of claim 4, wherein at least one of the plurality of perforations in the first perforated region overlaps at least one of the plurality of perforations in the second perforated region.

7. The heating element of claim 1, wherein the first and second CNT layers are formed from a folded CNT sheet.

8. The heating element of claim 1, wherein the plurality of perforations in the first perforated region comprise about 10% to about 50% of the first perforated region surface area.

9. The heating element of claim 8, wherein the plurality of perforations in the first perforated region comprise about 20% to about 40% of the first perforated region surface area.

10. The heating element of claim 1, wherein the plurality of perforations in the first perforated region have generally the same diameter.

11. The heating element of claim 1, wherein the plurality of perforations in the first perforated region are generally uniformly distributed.

12. A heating element comprising a perforated CNT sheet comprising:

a first perforated region having a plurality of perforations, a first perforation density, and a first electrical resistivity; and a second perforated region having a plurality of perforations and a second perforation density different from the first perforation density, wherein the second perforated region has a different number of perforations than the first perforated region, and wherein the second perforated region has a second electrical resistivity different than the first resistivity.

13. The heating element of claim 12, wherein perforations in the second perforated region have a different diameter than perforations in the first perforated region.

14. The heating element of claim 12, wherein the plurality of perforations in the first perforated region comprise about 10% to about 50% of the first perforated region surface area, and wherein the plurality of perforations in the second perforated region comprise about 10% to about 50% of the second perforated region surface area.

15. The heating element of claim 12, wherein the plurality of perforations in the first perforated region comprise about 20% to about 40% of the first perforated region surface area, and wherein the plurality of perforations in the second perforated region comprise about 20% to about 40% of the second perforated region surface area.

16. A method of forming a heating element containing carbon nanotubes, the method comprising:

perforating a first CNT layer so that it comprises:

a first perforated region having a plurality of perforations, a first perforation density, and a first electrical resistivity; and a second perforated region having a plurality of perforations and a second perforation density different from the first perforation density, wherein the second perforated region has a different number of perforations than the first perforated region, and wherein the second perforated region has a second electrical resistivity different than the first electrical resistivity; and stacking the first CNT layer with a second CNT layer such that at least a portion of the first perforated region of the first CNT layer overlaps at least a portion of the second CNT layer.

17. The method of claim 16, wherein the first and second CNT layers are stacked such that the perforated region overlaps with the portion of the second CNT layer.

18. The method of claim 16, further comprising:

perforating the second CNT layer so that it comprises a second perforated region having a plurality of perforations.

* * * * *